US007683752B1

(12) United States Patent
Huss

(10) Patent No.: US 7,683,752 B1
(45) Date of Patent: Mar. 23, 2010

(54) FUSE BOX SYSTEM

(76) Inventor: Roy A. Huss, 215 Dean Rd., Cleveland, NC (US) 27013

( * ) Notice: Subject to any disclaimer, the term of this patent is extended or adjusted under 35 U.S.C. 154(b) by 0 days.

(21) Appl. No.: 12/169,467

(22) Filed: Jul. 8, 2008

Related U.S. Application Data

(63) Continuation-in-part of application No. 11/620,243, filed on Jan. 5, 2007, now abandoned.

(51) Int. Cl.
*H11H 85/30* (2006.01)

(52) U.S. Cl. ..... 337/206; 361/626; 439/620.26

(58) Field of Classification Search ..... 337/206, 337/241; 439/620
See application file for complete search history.

(56) References Cited

U.S. PATENT DOCUMENTS 1,874,828 A * 8/1932 Suss ..... 337/197
4,281,322 A 7/1981 Nasu et al.
4,969,063 A 11/1990 Scott et al.
5,002,505 A 3/1991 Jones et al.
5,154,617 A * 10/1992 Suman et al. ..... 439/34
5,343,192 A 8/1994 Yenisey
5,556,305 A * 9/1996 Naegelin ..... 439/620.26
5,739,737 A 4/1998 Hatton
RE36,317 E 9/1999 Arratia
6,905,346 B2 * 6/2005 Momota et al. ..... 439/76.2
2006/0017540 A1 1/2006 Smith

* cited by examiner

*Primary Examiner*—Michael C Zarroli
(74) *Attorney, Agent, or Firm*—Crossley Patent Law; Mark A. Crossley

(57) ABSTRACT

A fuse box system that combines a series of specially designed fuses in a fuse box that allows an individual to see if one or more particular fuses within the fuse box are broken. The fuse has one of two different configurations, depending on whether the fuse is used in a system that is used in a polarized or non-polarized system. In each scenario, the fuse includes a number of diodes, one of which is a light emitting diode (LED) that will be lit up when the fuse is working and will not be lit up when the fuse is broken and/or not working.

2 Claims, 3 Drawing Sheets

FUSE BOX SYSTEM

CROSS-REFERENCE TO RELATED APPLICATIONS

U.S. application Ser. No. 11,620,243 filed Jan. 5, 2007

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved fuse box system that combines a series of specially designed fuses in a fuse box that allows an individual to see if one or more particular fuses within the fuse box are broken.

SUMMARY OF THE INVENTION

The present invention concerns that of a new and improved fuse box system that combines a series of specially designed fuses in a fuse box that allows an individual to see if one or more particular fuses within the fuse box are broken. The fuse has one of two different configurations, depending on whether the fuse is used in a system that is used in a polarized or non-polarized system. In each scenario, the fuse includes a number of diodes, one of which is a light emitting diode (LED) that will be lit up when the fuse is working and will not be lit up when the fuse is broken and/or not working. The fuse includes an outer casing with the electrical circuitry of the fuse located within the outer casing, which is designed to be transparent to allow for easy viewing. The LED, along with the remainder of the internal circuitry within the fuse, is fixedly attached and is completely located within the casing of the fuse, thereby preventing the circuitry or LED from being touched, jostled, or otherwise broken by an external source. A resistor acts as a current limiting resistor, the resistor being in series with a third diode and in parallel with a first and second diode. In one embodiment, the third diode is a LED. Electricity passing through each fuse normally flows through the first and second diode while electricity flows through the third diode and the resistor when the first diode and the second diode is broken, thereby providing light as a notification that the respective fuse is broken. Other diode-resistor configurations working on the same concept also provide notification that a fuse is broken.

There has thus been outlined, rather broadly, the more important features of a fuse box system that the detailed description thereof that follows may be better understood and in order that the present contribution to the art may be better appreciated. There are, of course, additional features of the fuse box system that will be described hereinafter and which will form the subject matter of the claims appended hereto.

In this respect, before explaining at least one embodiment of the fuse box system in detail, it is to be understood that the fuse box system is not limited in its application to the details of construction and to the arrangements of the components set forth in the following description or illustrated in the drawings. The fuse box system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present fuse box system. It is important, therefore, that the claims be regarded as including such equivalent constructions insofar as they do not depart from the spirit and scope of the present invention.

It is therefore an object of the present invention to provide a fuse box system which has all of the advantages of the prior art and none of the disadvantages.

It is another object of the present invention to provide a fuse box system which may be easily and efficiently manufactured and marketed.

It is another object of the present invention to provide a fuse box system which is of durable and reliable construction.

It is yet another object of the present invention to provide a fuse box system which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
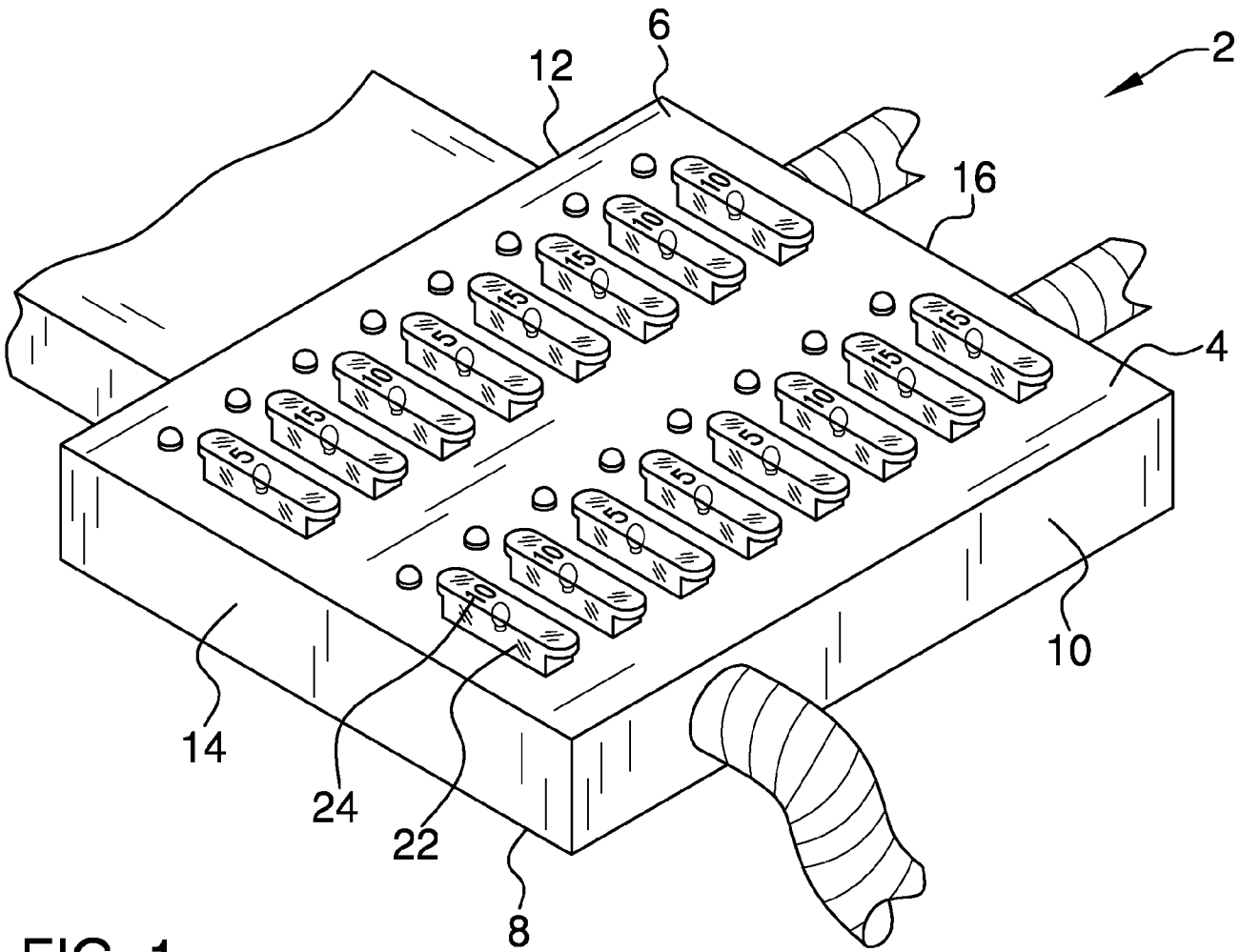
FIG. 1 shows a perspective view of the present invention.
Figure 2:
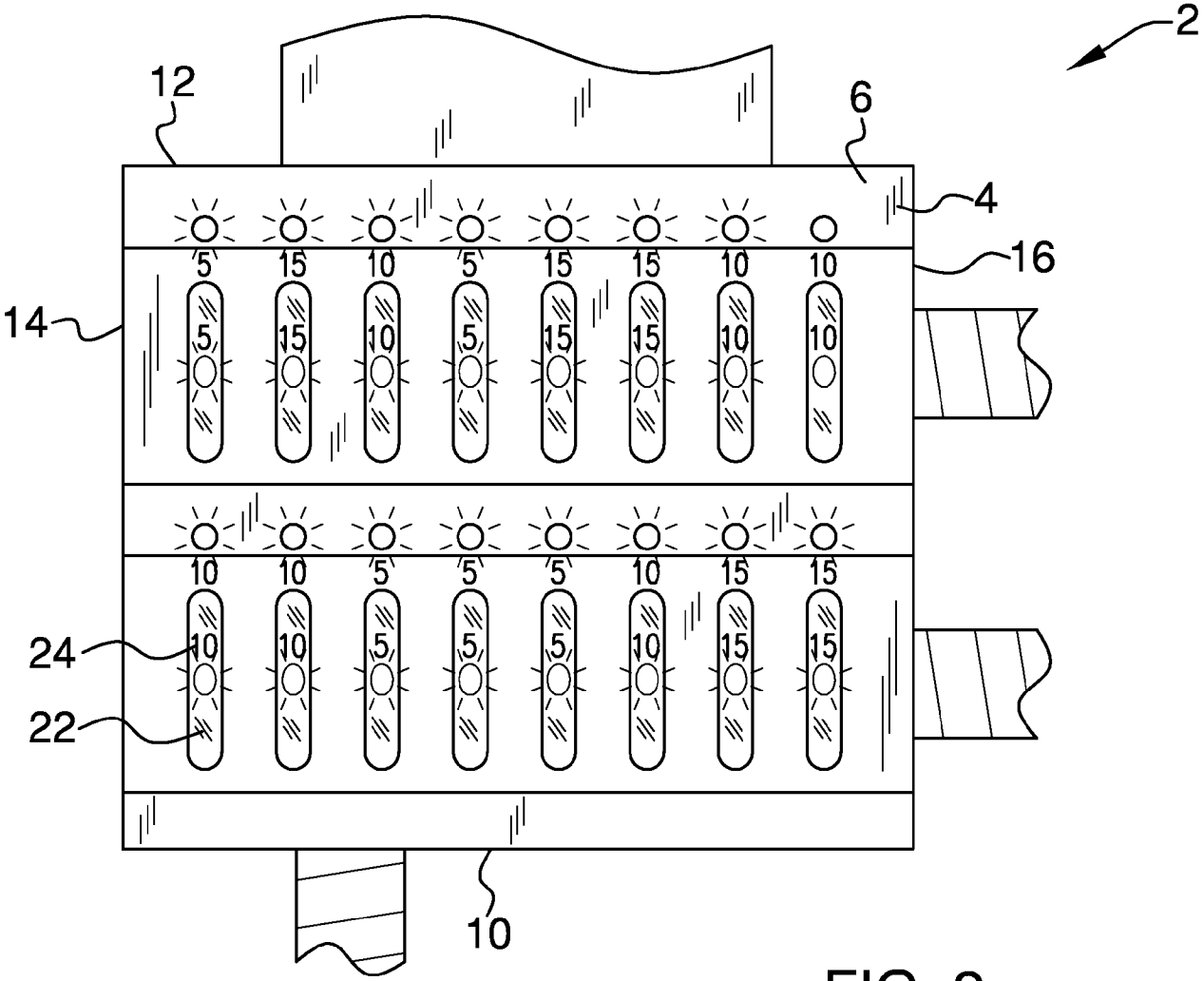
FIG. 2 shows a top view of the present invention.

With reference now to the drawings, and in particular to FIGS. 1 through 4 thereof, a fuse box system embodying the principles and concepts of the present invention and generally designated by the reference numeral 2 will be described.

As best illustrated in FIGS. 1 through 4, the fuse box system 2 comprises an outer casing 4 that has two surfaces comprising an upper surface 6 and a lower surface 8. The outer casing 4 also includes a front side surface 10, a rear side surface 12, a left side surface 14, and a right side surface 16.

The fuse box system 2 includes at least one incoming power line 18 and at least one outgoing power line 20. Preferably, the fuse box system 2 has three separate outgoing power lines 20.

A plurality of fuses 22 are inserted through the upper surface 6 of the outer casing 4 and partially stick out of the upper surface 6 of the outer casing 4. Each fuse has a numerical designation 24 on it to designate the particular maximum amps that it can tolerate before it will short out and need to be replaced.

Figure 3:
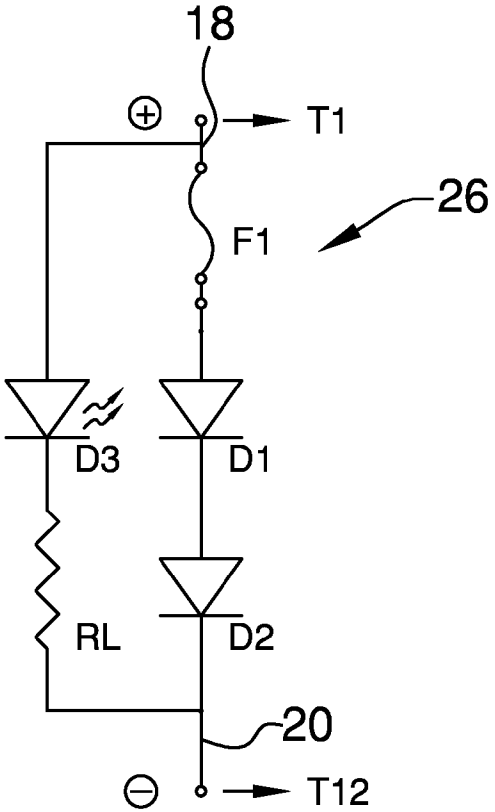
FIG. 3 shows the electronic layout located within a fuse that is used with a polarized electrical system.

In a polarized system fuse 26, as represented in FIG. 3, the incoming power line 18 inputs electricity into the fuse box system 2, while each of the outgoing power lines 20 sends power outward away from the fuse box system. In a non-polarized system, the power line designated as number 18 in FIGS. 1 and 2 can be either the incoming power line or the outgoing power line, while the power line designated as item number 20 would be the opposite that of item number 18.

In FIG. 3, the electronic schematic for the polarized system is shown. Current passes through the system from T1 to T12. Three diodes are present, designated as diodes D1, D2, and D3. D1 and D2 are shown to be in series with one another, while D3 is in parallel to D1 and D2. In series with D3 is a resistor designated as RL that acts as a current limiting resistor. D3 is a light emitting diode (LED).

Normally, current passes through D1 and D2 to the presence of less resistance. However, once D1 and/or D2 is broken or does not function, the current's only path is through "the path of greater resistance"—through D3. Once the current passes through D3 in a large enough degree, the D3 will light up, allowing an individual to see that the polarized system fuse 26 is broken and needs to be replaced.

Figure 4:
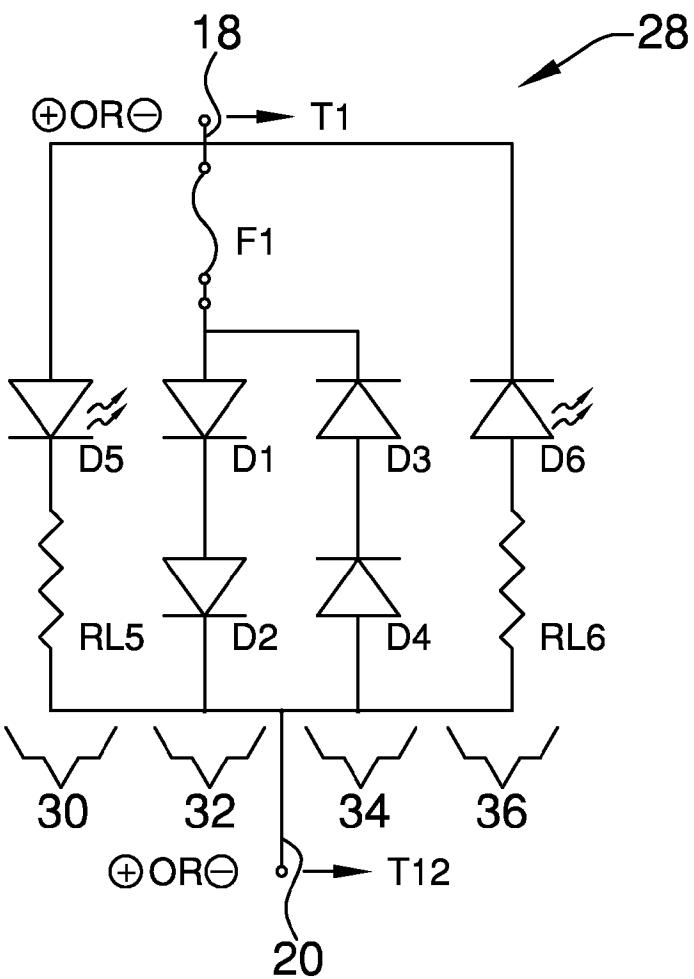
FIG. 4 shows the electronic layout located within a fuse that is used with a non-polarized electrical system.

In a non-polarized system fuse 28, as represented in FIG. 4, either the incoming power line 18 or the outgoing power line 20 inputs electricity into the fuse box system 2, while the power then exits out of the other one of the pair.

In FIG. 4, the electronic schematic for the polarized system is shown. Current passes through the system between T1 to T12 and can pass from one to the other in no particular order. Four groupings of objects are present on non-polarized system fuse 28, with each of these groupings being in parallel to one another. Grouping 30 includes diode D5 and current limiting resistor RL5, which are in series to one another. Grouping 32 includes diodes D1 and D2, which are in series to one another. Grouping 34 includes diodes D3 and D4, which are in series to one another. Finally, grouping 36 includes D6 and RL6, which are in series to one another. In the non-polarized system fuse 28, diodes D5 and D6 are both LED's and serve as alternative current pathways for D1 and D2 (for diode D5) and D3 and D4 (for diode D6).

Diodes D5, D1, and D2 allows current to flow from T1 to T12, while diodes D3, D4, and D6 allow current to flow from T12 to T1. Essentially, diodes D3, D4, and D6 are placed within non-polarized system fuse 28 facing the opposite way of that of diodes D5, D1, and D2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A fuse box system comprising an outer casing, the outer casing comprising two surfaces comprising an upper surface and a lower surface, the outer casing also having four side surfaces comprising a front side surface, a rear side surface, a left side surface, and a right side surface, a first power line attached to the outer casing, wherein said first power line comprises an incoming power line, a second power line attached to the outer casing, wherein said second power line comprises an outgoing power line, a plurality of fuses inserted through the upper surface of the outer casing, wherein the plurality of fuses stick out partially from the upper surface of the outer casing, wherein electricity that passes through the first power line and second power line passes through each fuse within the plurality of fuses, further wherein each fuse of the plurality of fuses has a numerical designation, further wherein each fuse of the plurality of fuses is a polarized system fuse, and means for notifying an individual if a fuse of the plurality of uses is blown, said means further comprising a pair of diodes comprising a first diode and a second diode, said first diode and second diode being in series with one another, a third diode, wherein the third diode is a light emitting diode, a resistor, said resistor acting as a current limiting resistor, having electricity route through the first and second diode when the fuse box system is in use, placing the third diode parallel to the first diode and second diode and the resistor in series with the third diode and parallel with the first and second diode, thereby providing an alternative pathway for electricity to travel should a fuse within the fuse box system malfunction and thereby lighting up the third diode, wherein each fuse of the plurality of fuses has a numerical designation, wherein each fuse of the plurality of fuses is a polarized system fuse, wherein the first power line attached to the outer casing comprises an incoming power line, further wherein the second power line attached to the outer casing comprises an outgoing power line, wherein the means for notifying an individual if a particular fuse of the plurality of fuses is blown further comprises a pair of diodes comprising a first diode and a second diode, said first diode and second diode being in series with one another, a third diode, said third diode being parallel to the first diode and second diode, a resistor, said resistor acting as a current limiting resistor, the resistor being in series with the third diode, said resistor being in parallel with the first and second diode, wherein the third diode is a light emitting diode, further wherein electricity passing through each fuse normally flows through the first and second diode, further wherein electricity flows through the third diode and the resistor when the first diode or the second diode is broken, thereby providing light as a notification that the respective fuse is broken.

2. A fuse box system comprising an outer casing, the outer casing comprising two surfaces comprising an upper surface and a lower surface, the outer casing also having four side surfaces comprising a front side surface, a rear side surface, a left side surface, and a right side surface, a first power line attached to the outer casing, wherein said first power line comprises either an incoming power line or outgoing power line, a second power line attached to the outer casing, wherein said second power line comprises either an incoming power line or an outgoing power line, a plurality of fuses inserted through the upper surface of the outer casing, wherein the plurality of fuses stick out partially from the upper surface of the outer casing, wherein electricity that passes through the first power line and second power line passes through each fuse within the plurality of fuses, wherein each fuse of the plurality of fuses has a numerical designation, wherein each fuse of the plurality of fuses is a non-polarized system fuse, means for notifying an individual if a particular fuse of the plurality of fuses is blown further comprising a pair of diodes comprising a first diode and a second diode, said first diode and second diode being in series with one another, a third diode, wherein the third diode is a light emitting diode, a first resistor, said first resistor acting as a current limiting resistor, a second pair of diodes comprising a fourth diode and a fifth diode, a sixth diode, wherein the sixth diode is a light emitting diode, a second resistor, said second resistor acting as a current limiting resistor, placing the third diode parallel to the first diode and second diode and placing the first resistor in series with the third diode and parallel with the first and second diode, thereby providing an alternative pathway for electricity to travel when the electricity is traveling from the first power line to the second power line should a fuse within the fuse box system malfunction and thereby lighting up the third diode, placing the fourth diode and fifth diode of the second pair of diodes in series with one another, in parallel to the first pair of diodes, and in parallel to the third diode and the first resistor, placing the sixth diode in parallel to the first diode and second diode and in parallel to the fourth diode and fifth diode, placing the second resistor in series with the sixth diode, in parallel with the first and second diode, and in parallel with the fourth and fifth diode, thereby providing an alternative pathway for electricity to travel when the electricity is traveling from the second power line to the first power line should a fuse within the fuse box system malfunction and thereby lighting up the sixth diode.

* * * * *